United States Patent [19]

Ritchie

[11] Patent Number: 4,606,545

[45] Date of Patent: Aug. 19, 1986

[54] BI-LEVEL PINBALL MACHINE PROVIDING INTERLEVEL BALL TRAVEL

[75] Inventor: Steven S. Ritchie, Carpentersville, Ill.

[73] Assignee: Williams Electronics, Inc., Chicago, Ill.

[21] Appl. No.: 320,012

[22] Filed: Nov. 10, 1981

Related U.S. Application Data

[63] Continuation of Ser. No. 200,489, Oct. 24, 1980, abandoned.

[51] Int. Cl.[4] ..... A63F 7/02

[52] U.S. Cl. ..... 273/121 A

[58] Field of Search ..... 273/110, 113, 119 R, 273/119 A, 121 R, 121 A, 122 R, 122 A, 124 R, 124 A

[56] References Cited

U.S. PATENT DOCUMENTS

| | | | |
|---|---|---|---|
| 2,704,212 | 3/1955 | Dunseth | 273/124 R X |
| 2,791,431 | 5/1957 | Scaroulis | 273/121 R X |
| 3,582,074 | 6/1971 | Menotti | 273/121 A X |

FOREIGN PATENT DOCUMENTS

| | | | |
|---|---|---|---|
| 954 | 2/1900 | Austria | 273/124 R |
| 2040777 | 3/1972 | Fed. Rep. of Germany | 273/121 R |
| 1373806 | 8/1964 | France | 273/121 A |
| 1422335 | 11/1965 | France | 273/121 A |

*Primary Examiner*—Anton O. Oechsle

*Attorney, Agent, or Firm*—McDougall, Hersh & Scott

[57] ABSTRACT

A pinball machine having a plurality of inclined playfields is provided. The adjacent playfields are linked by at least one path allowing a ball to descend to the lower playfield and a path allowing a ball to be propelled by a player controlled flipper to the upper playfield.

1 Claim, 4 Drawing Figures

896,420

BI-LEVEL PINBALL MACHINE PROVIDING INTERLEVEL BALL TRAVEL

This is a continuation, of application Ser. No. 200,489, filed Oct. 24, 1980, now abandoned.

BACKGROUND OF THE INVENTION

This invention relates generally to pinball machines and more specifically to pinball machines having a multiple level playfield. As used herein, "playfield" refers to the active playing area in a pinball machine.

A conventional pinball machine includes a spring loaded plunger for impelling a ball onto the upper portion of an inclined planar board comprising the playfield. A variety of devices are normally incorporated in these machines such as bumpers, kickers, targets, and flippers which are activated by external player controlled buttons. The object of the player is to keep the ball in play as long as possible and to score as many points as possible by hitting the various targets. A numerical display shows the player's cumulative score.

PRIOR ART

It is well known in the field of pinball machines to provide a sub-floor beneath a playfield having one or more holes or openings through which the ball in play may fall, thereby terminating play with that ball. Such a sub-floor is normally inclined to accumulate the balls in a position for the next round of play.

U.S. Pat. No. 3,582,074 discloses a pinball game having two playfields, sloped in opposite directions, in which are provided holes, doors, and bumpers in addition to ball impelling elements. The upper ends of each of the sloped play fields are adjacent each other, thereby effectively providing a rectangular playfield which slopes towards each end from an elevated mid-section apex.

French Pat. No. 1,422,335 discloses a pinball machine having a plurality of parallel inclined playfields wherein each such playfield has a hole or a ramp to allow the ball to descend to successively lower levels. Upper levels are transparent so that the view of lower levels is not blocked. One embodiment of the invention disclosed in this patent includes a common vertical shaft connecting each of the parallel playfields and an elevating device located within the shaft for carrying balls that fall into the shaft to an upper level.

SUMMARY OF THE INVENTION

The present invention provides a pinball machine having a plurality of parallel inclined playfields which are linked by at least one path allowing the ball to descend to the next lower playfield and a path allowing a ball to be propelled by a player controlled flipper to an upper playfield. Both the up and down paths between adjacent playfields may be comprised of a single ramp which permits bidirectional travel of the ball. By skillful control of flippers located on a lower playfield, a player can impel a ball up a ramp to the upper playfield for further action at that level. In the illustrative embodiment, additional flippers are employed near the entrance to the ramp on the upper playfield to allow the player an opportunity to prevent the ball from returning by this path to the lower playfield. This invention also provides a means for initially delivering a ball onto the uppermost playfield.

An object of the present invention is to provide a new and exciting challenge of the player's skills by means of a pinball machine having a playfiled consisting of more than one playing level wherein a player can cause a ball to travel between levels.

The scope of the present invention is defined by the claims appended hereto and the preferred embodiment of the present invention is illustrated by drawings in which:

DETAILED DESCRIPTION OF THE PREFERRED EMBODIMENT

Figures 1, 3, 4:
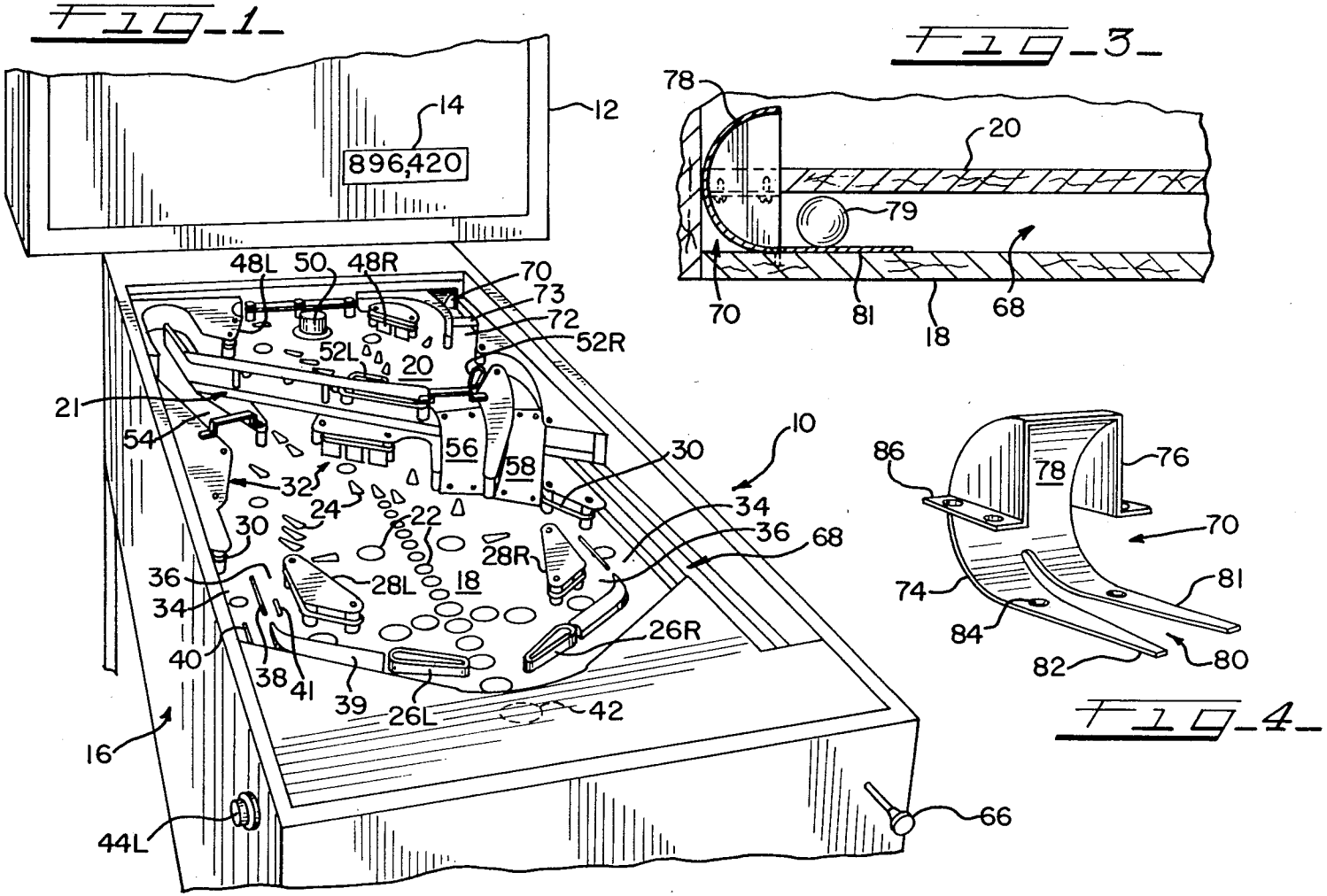
FIG. 1 is a partial perspective of a pinball machine embodying the present invention.
FIG. 3 is a partial cross-sectional view taken about line 3—3 in FIG. 2.
FIG. 4 is an isometric view of an arcuate channel used to deliver a ball onto the upper playfield.
Figure 2:
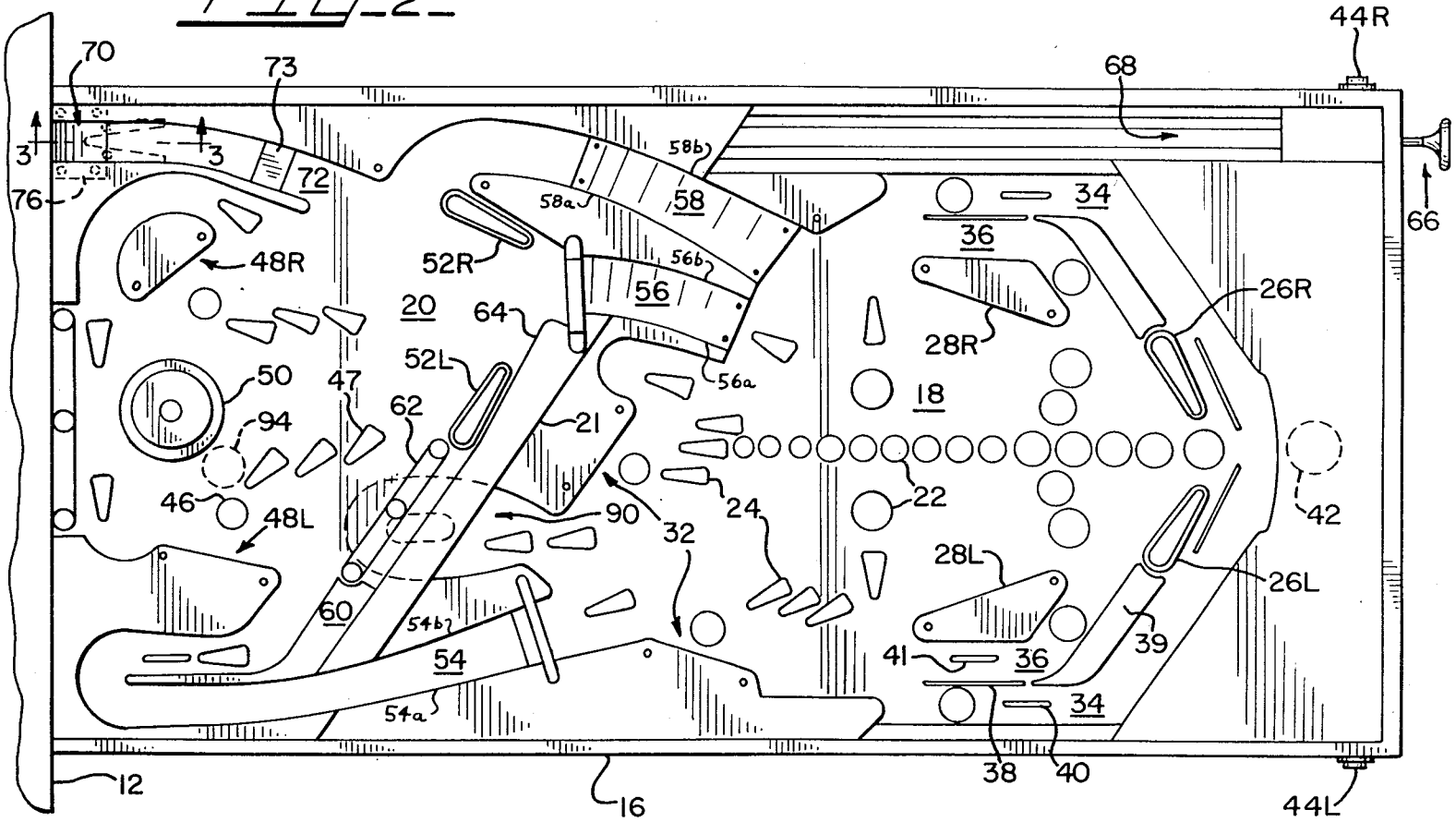
FIG. 2 is a top view of the playfield of the preferred embodiment of the present invention.

Referring in particular to FIGS. 1 and 2, a pinball machine 10 is illustrated having a head 12, which includes numerical score display 14, and a cabinet 16 which is supported by four conventional legs. A lower playfield 18 and an upper playfield 20 are housed within cabinet 16.

The lower playfield contains a pluality of circular inserts 22 and arrow shaped inserts 24 which comprise plastic transparent inserts of varying colors that are recessed even with the surface of the playing field. Individual lights are disposed beneath each insert and are controlled in a conventional manner either in response to ball contact switches or by other means. The playfield 18 also contains a player operable means for propelling a ball such as complementary left and right flippers 26L and 26R, and sling-shot kickers 28L, 28R, as well as bumpers 30, and drop targets 32. The flippers are controlled by solenoids which are responsive respectively to left and right push buttons 44L, 44R. In the illustrative embodiment, two exit lanes 34 and flipper return lanes 36 are separated by dividers 38 and 39. Exit lane 34 and flipper return lane 36 have respectively ball sensing switches 40 and 41. A ball may exit out-hole 42 either by passing directly between the flippers 26 or by exit lanes 34.

Upper playfield 20 contains similar features including circular light inserts 46, arrow light inserts 47, drop targets 48L, 48R, a kicker 50 and flippers 52L, 52R. Push buttons 44L, 44R, control respectively flippers 52L, 52R, as well as flippers 26L, 26R. Preferably the push buttons have sequentially staggered contacts such that the flippers controlled by each are not energized simultaneously. For example, push button 44L can include sequential contacts connected such that depressing this push button inwardly would first energize the solenoid controlling flipper 26L and then activate the solenoid controlling flipper 52L. Completely depressing push button 44L thus causes both left flippers to operate. Sequential activation of the flippers is desirable because the current drawn by the respective solenoids does not occur simultaneously but at spaced time intervals thereby minimizing any momentary voltage drop in the power supply which drives the solenoids allowing full power for flipper activation. The solenoid utilized in the preferred embodiment consists of conventional 28 volt DC solenoids which are powered by a 28 volt DC power supply.

The playfield 20 is parallel to and mounted above an upper portion of inclined planar playfield 18 by suitable spacers. Inclined ramps 54, 56 and 58 provide different paths connecting the upper playfield to the lower playfield. These ramps provided a means by which balls may descend by gravity from the upper to the lower playfield and provide a means by which balls may be propelled from the lower playfield to the upper playfield. In the preferred embodiment, flippers 52L, 52R guard the upper entrance to ramp 56 thereby providing the player with an opportunity to prevent a ball on upper playfield 20 from descending by gravity to the lower playfield by means of a ramp 56. Ramp 54 has a U-shaped portion on upper playfield 20 requiring that a ball must be shot down as well as up this ramp. The ramps 54, 56, 58 may be made out of any suitable material, such as strips of sheet metal, and preferably have side walls 54*a*, 54*b*, 56*a*, 56*b*, 58*a*, 58*b*, respectively to prevent balls from falling off.

Adjacent the lowermost edge 21 of upper playfield 20 is divider 60, bumper 62, flipper 52L, and divider 64 which prevent balls on upper playfield 20 from falling to the lower playfield 18.

In the illustrative embodiment, a spring loaded plunger 66 provides a means for impelling a ball up an inclined track 68 mounted to lower playfield 18 and around an arcuate channel 70 which connects track 68 with upper playfield 20. FIG. 1 illustrates that a portion of the track is disposed between the playfields. The arcuate channel delivers a ball onto entry chute 72 of upper playfield 20 in a direction opposite to the travel of the ball in the track, i.e. in a direction parallel to the longitudinal center line of cabinet 16. A one directional gate 73 mounted to chute 72 allows a ball to be shot onto playfield 20 but prevents a ball from entering the chute from the playfield.

Now referring in particular to FIGS. 3 and 4, the arcuate channel 70 and its relation to the playfield is illustrated. The arcuate channel is comprised of a suitable material such as a formed strip of sheet metal 74 and has a mounting bracket 76. A portion 78 of strip 74 is formed into a semicircular configuration having a radius of curvature greater than the diameter of ball 79. The strip 74 has a V-shaped slot 80 which separates guides 81 and 82 which contain countersunk holes 84 that are utilized to mount the guides to the bottom of track 68 by means of screws. The V-shaped slot 80 is designed to provide a smooth transition of the ball from track 68 to channel 70. Mounting bracket 76 has two outwardly extending flanges 86 which have two holes therein. The holes in flanges 86 allow the bracket 76 to be mounted directly to the playing surface of upper playfield 20. Bracket 76 which is preferably formed of sheet metal can be secured to the upper semicircular portion 78 of strip 74 by any conventional means such as welding. Channel 70 provides a unique means for delivering the ball 79 onto upper playfield 20 so as to maximize the usable area on playfield 20 by minimizing the area allocated for entry of a ball onto the playfield.

As best seen in FIG. 3, the lower playfield 18 and upper playfield 20 are comprised of conventional materials such as half inch plywood sheets and are preferably spaced apart by a distance slightly greater than the diameter of ball 79 which is shown entering arcuate channel 70. Upper playfield 20 could be constructed of a suitable transparent material.

Now referring more specifically to FIG. 2, it will be seen that a horseshoe feature 90 on lower playfield 18 extends underneath the coextensive portion of upper playfield 20. A horseshoe feature provides a means for making a 180 degree U-turn of a ball. This horseshoe feature is merely illustative that the area of playfield 18 underneath upper playfield 20 is usable as part of lower playfield 18 and may have a variety of features thereon.

While the preferred embodiment of the present invention has provided ramps 54, 56, 58 which provide a bidirectional path for ball travel, conventional one-way gates could be employed so as to convert selective ramps to one-way directional paths. Of course, means other than ramps may be used to provide a path from the upper playfield to the lower playfield, such as a hole 94 in the upper playfield, as shown in dashed line in FIG. 2. Also, multiple balls could be simultaneously played on the playfields. Although each playfield was constructed from different sheets of material as described above, a single sheet of suitable material could be appropriately contoured so as to provide different levels of play.

It will be apparent from the above description and drawings that the instant invention provides a new concept in pinball machines which will test a player's skill while providing exciting playfield action. It will be apparent to those skilled in the art that various playfield devices and features can be incorporated and modifications made without departing from the spirit of the present invention.

What is claimed is:

1. An improved pinball machine having an inclined first playfield which includes targets and at least one flipper operable by a player for propelling a ball in play on the first playfield, the improvement comprising:

(a) a second playfield substantially parallel above said first playfield;

(b) a bidirectional ball path having a first open end on said first playfield and a second open end connected to said second playfield, said first end opening toward said flipper so that the latter can directly propel a ball on said first playfield via said path onto said second playfield or a ball may travel from second playfield to said first playfield, said second end disposed on said second playfield so that a ball may descend to said first playfield or ascend to said second playfield;

(c) another flipper disposed on said second playfield adjacent said second open end of the path for propelling a ball on said second playfield away from said path, said another flipper selectively operable by the player to prevent a ball on the second playfield from entering said path and descending to the first playfield thereby providing the player with the opportunity to keep a ball in play on the second playfield; and (d) a plunger adjacent the lower end of said first playfield, a track means extending from the free end of said plunger for guiding a ball propelled by the plunger, an arcuate channel having a ball entrance disposed below the surface of the second playfield to receive a ball from the track means, and a ball disposed above the level of said second playfield so that balls enter the second playfield traveling in a direction 180 degrees opposite from the direction of travel of the balls just prior to entering the arcuate channel and substantially at the level of the second playfield.

* * * * *